US008143200B2

(12) United States Patent
Vaughn et al.

(10) Patent No.: US 8,143,200 B2
(45) Date of Patent: Mar. 27, 2012

(54) ENHANCEMENT OF LOW TEMPRATURE PERFORMANCE OF GROUP III BASE STOCKS BY BLENDING WITH HVI-PAO

(75) Inventors: Nicole D. Vaughn, Sicklerville, NJ (US); Jacob Joseph Habeeb, Westfield, NJ (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 224 days.

(21) Appl. No.: 12/584,238

(22) Filed: Sep. 1, 2009

(65) Prior Publication Data

US 2010/0062959 A1 Mar. 11, 2010

Related U.S. Application Data

(60) Provisional application No. 61/190,714, filed on Sep. 2, 2008.

(51) Int. Cl.
*C10M 169/04* (2006.01)
*C10L 1/16* (2006.01)
*C10G 71/00* (2006.01)

(52) U.S. Cl. ..... 508/110; 208/18; 508/591

(58) Field of Classification Search ..... 508/110, 508/591; 208/18

See application file for complete search history.

(56) References Cited

U.S. PATENT DOCUMENTS

| | | | | |
|---|---|---|---|---|
| 5,358,628 | A | 10/1994 | Apelian et al. | |
| 5,643,440 | A | 7/1997 | Borghard et al. | |
| 5,885,438 | A | 3/1999 | Apelian et al. | |
| 2007/0000807 | A1 * | 1/2007 | Wu et al. | 208/18 |
| 2007/0095392 | A1 | 5/2007 | Billings | |
| 2007/0142242 | A1 | 6/2007 | Gleeson et al. | |
| 2007/0289897 | A1 | 12/2007 | Carey et al. | |
| 2008/0020954 | A1 | 1/2008 | Haigh et al. | |

* cited by examiner

*Primary Examiner* — Walter D Griffin
*Assistant Examiner* — Francis C Campanell
(74) *Attorney, Agent, or Firm* — Robert A. Migliorini

(57) ABSTRACT

A lubricating oil formulation is disclosed inhibiting a pour point of about −45° C. or lower and a Brookfield viscosity at −40° C. of about 60,000 cP or less comprising a mixture of a base stock selected from the group consisting of a Group III base stock, a GTL base stock, synthetic and natural waxy hydrocarbon hydroisomerate base stock, and mixtures thereof in combination with HVI-PAO. Also disclosed is a method for reducing the pour point and enhancing the −40° C. Brookfield viscosity performance of a lubricating oil comprising a base stock selected from the group consisting of Group III base stock, GTL base stock, synthetic and natural waxy hydrocarbon hydroisomerate base stock, and mixtures thereof by adding HVI-PAO to such base stock.

16 Claims, No Drawings

ENHANCEMENT OF LOW TEMPRATURE PERFORMANCE OF GROUP III BASE STOCKS BY BLENDING WITH HVI-PAO

CROSS-REFERENCE TO RELATED PATENT APPLICATIONS

This is a Non-Provisional Application that claims priority to U.S. Provisional Application 61/190,714 filed Sep. 2, 2008, which is herein incorporated by reference.

BACKGROUND OF THE INVENTION

1. Field of the Invention

The present invention relates to lubricating oil formulations having low pour points and good low temperature Brookfield viscosities.

2. Description of the Related Art

In the industry there is a current trend to lubricating oil formulations possessing and exhibiting enhanced low temperature performance, as evidenced by lower pour points and lower −40° C. Brookfield viscosities. This trend is especially relevant in transmission fluid formulations where good low temperature properties are essential to ensure adequate lubrication at low temperatures which may be encountered upon equipment start-up. Low −40° C. Brookfield viscosity is also essential for enhanced fuel economy.

US2007/0000807 (WO 2007/005094) teaches industrial lubricant and grease compositions containing high viscosity index polyalphaolefins (HVI-PAO). The use of HVI-PAO in such compositions provides improved shear stability, enhanced anti-wear performance, superior foam properties, energy efficiency, etc. HVI-PAO is prepared by the polymerization of alpha olefins using reduced metal oxide catalysts such as described in U.S. Pat. No. 4,827,064, U.S. Pat. No. 4,827,073, U.S. Pat. No. 4,990,771, U.S. Pat. No. 5,012,020 and U.S. Pat. No. 5,264,642. HVI-PAO can also be made using zeolite catalysts, activated metallocene catalysts or Zeigler-Natta (Z-N) catalysts.

HVI-PAOs are characterized by having a high viscosity index and one or more of a branch ratio of less than 0.19, a weight average molecular weight of between 300 and 45,000, a number average molecular weight of between 300 and 18,000, a molecular weight distribution of between 1 and 5, a pour point below −15° C., and a kinematic viscosity at 100° C. in the range of from 3 cSt to 15,000 cSt. Materials of the type are commercially available, such as Spectra Syn Ultra™ fluid from ExxonMobil Chemical Company. US2007/0000807 teaches that such fluids, preferably those with viscosity indexes of 130 or greater, are particularly useful in formulating gear oils, circulating oils, compressor oils, hydraulic fluids, refrigeration lubes, metalworking fluids and greases. The HVI-PAO is used as such or can be mixed with at least one other ingredient selected from conventional PAO, esters, polyethers, polyether esters, alkylaromatic fluids, polyalkylene glycols, Group I base stock, Group II or Group III hydroprocessed base stock or lubricant oils derived from hydroisomerized waxy stocks, such as slack wax or waxy Fischer-Tropsch hydrocarbons.

Group II or Group III stocks are high viscosity index and very high viscosity index base stocks, respectively. The Group III oils generally contain fewer unsaturates and less sulfur than the Group II oils. In '807 it is indicated that the Group III stocks are materials such as those disclosed in U.S. Pat. No. 5,885,438, U.S. Pat. No. 5,643,440 and U.S. Pat. No. 5,358,628. In '438 the stock is a high VI wax isomerate made by isomerizing slack wax, F-T wax, waxy feed such as petroleum, VGO or raffinate. In '440 the high VI material is made by a two-step process of hydrocracking-hydroisomerizing wax. In '628 the high VI material is made by the two-step process of hydrocracking-hydroisomerizing petroleum waxes.

It is stated that the lubricants of '807 have superior properties and performance features, including excellent viscometrics, high VI, low pour point, superior low temperature viscosities, thermal oxidative stability, etc. In the text, examples are given only of HVI-PAO per se or of mixtures of HVI-PAO in combination with conventional PAO and/or in combination with conventional mineral oils identified as a mixture of a 4 cSt paraffinic solvent dewaxed stock and a 3 cSt naphthenic base stock, both of which are Group I stocks. In examples of synthetic anti-wear gear oils in the 75W90 to 75W140 range, the formulations exhibited −40° C., Brookfield viscosities of from 61,500 cP to 147,600 cP and pour points of <−65° C. to −55° C. The formulations in these examples included base stocks which were a mixture of HVI-PAO, conventional PAO and other base stocks with higher polarity, especially Group V base stocks including esters or alkylated aromatics of lower viscosity (1.3 to 6 cSt).

US2008/0020954 is directed to a lubricant formulation comprising at least two base stocks; the first has a Kinematic Viscosity @ 100° C. greater than 300 cSt and a tight molecular weight distribution, while the second stock has a Kinematic Viscosity @ 100° C. of less than 100 cSt. The first stock is identified as a metallocene catalyzed PAO with a KV@100° C. of 300 cSt or greater while the second stock can be a low viscosity PAO, one or more Group V base stocks such as an ester, polyalkylene glycol or an alkylated aromatic while Group II and/or Group III hydroprocessed or hydrocracked base stocks or their synthetic counterparts such as PAO, GTL or similar base stocks or mixtures thereof are also embraced. It is stated that favorable improvements are observed when the first high viscosity stock is added to lubricating systems comprising primarily Group II, Group III and/or GTL base stocks (page 9, para. [0089]). Despite this statement there are no examples in which the second base stock is anything other than a PAO of lower kinematic viscosity in combination with alkylated naphthalene, phalate ester and adipate ester along with a gear oil additive package.

US2007/0142242 is directed to a method for improving the performance of lubricating oils of high viscosity comprising GTL base stocks in combination with an effective amount of a polyolefin fluid having a KV@100° C. in the range between about 10 to about 1,000 $mm^2/s$. Such lubricating oils are described as exhibiting improved oxidation stability, low temperature properties, viscosity retention and shear stability/weight retention superior to that exhibited by GTL additized with conventional viscosity modifiers and superior to that exhibited by Group I and Group II oils additized with the same polyolefin fluid or with a conventional viscosity modifier. The polyolefin fluid can be made using a catalyst system comprising a metallocene and an aluminoxane. In the example, however, use is made only of either ethylene-butene copolymers of KV@100° C. of 28 $mm^2/s$ or 114 $mm^2/s$ or of PAO −100 $mm^2/s$ (neither of which are HVI-PAO) in combination with the GTL or Group II base stocks.

WO 2007/095392 is directed to a base oil having a low dynamic viscosity as measured by ASTM D5133 which comprises a blend of about 65 to 97.5 wt % of a paraffinic oil having a VI of 130 or greater, a KV@100° C. of about 3.8 $mm^2/s$ or greater and a pour point of −15° C. or less and an ester of lubricating viscosity in an amount of from about 35 to about 2.5 wt %. The text goes on to describe the paraffinic oil as being made from waxy feed stocks to meet the requirement of a Group III base stock. Waxy feed stocks are identified as being either conventional natural, mineral stocks or stocks produced by synthetic processes exemplified by gas-to-liquids synthetic process on the Kolbel-Engelhardt process or the Fischer-Tropsch process. Such waxy stocks are processed by hydrotreating, hydrodewaxing and hydrofining to produce the desired paraffinic oil stock. No mention is made of using HVI-PAO anywhere in the text or in any of the Examples.

DESCRIPTION OF THE INVENTION

It has been discovered that lubricating oil formulations comprising base stocks selected from the group consisting of Group III hydroprocessed base stocks, GTL base stock, synthetic or natural waxy hydrocarbon hydroisomerized base stock and mixtures thereof can be formulated to exhibit enhanced pour points of about −45° C. or lower, preferably about −50° C. or lower, and −40° C. Brookfield viscosity of about 60,000 cP or less, preferably about 35,000 cP or less, more preferably about 30,000 cP or less, still more preferably about 25,000 cP or less by adding HVI-PAO to such base stocks in an amount of at least about 10 wt %, preferably at least about 22.5 wt %, more preferably at least about 45 wt % of the total lubricating oil formulation, and wherein the weight ratio of HVI-PAO to Group III base stock or GTL base stock, or hydrodewaxed or hydroisomerized/cat (and/or solvent) dewaxed synthetic or natural waxy hydrocarbon base stock or mixtures thereof is at least about 1:2, preferably about 1:1, most preferably about 2:1.

Traditionally, PAO-4 (4 cST PAO) has been used in synthetic transmission fluid to assist in meeting stringent low temperature Brookfield viscosity requirements and low pour point due to the excellent properties of PAO-4. It has been found that base stocks selected from the group consisting of Group III hydroprocessed base stock, GTL base stock, synthetic and natural waxy hydrocarbon hydroisomerate base stocks and mixtures thereof when blended with HVI-PAO instead of with conventional higher KV PAO have low temperature performance comparable to that of fluids using PAO-4 in combination with conventional higher KV PAO at the same concentration; that is, unexpectedly it has been found that when Group III, GTL waxy feed isomerate or mixtures thereof is combined with HVI-PAO, the result obtained is similar to that observed when PAO-4 is mixed with conventional higher KV PAO. Conventional higher KV PAO is identified for the purposes of this text to be PAO having a KV @ 100° C. of about 80 to 140 $mm^2/s$ (cSt), more usually about 100 $mm^2/s$.

It is unexpected that Group III hydroprocessed oil, GTL base stock, synthetic or natural waxy hydrocarbon hydroisomerate base stock and mixtures thereof can be combined with HVI-PAO to achieve the same or superior level of low temperature viscometric performance as has hitherto been achievable only by use of a combination of PAO-4 and conventional PAO (e.g., PAO-100) or by the combination of PAO-4 and HVI-PAO. That such Group III hydroprocessed base stock, GTL base stock, synthetic or natural waxy hydrocarbon hydroisomerate base stock and mixtures thereof can replace PAO-4 or PAO-100 as the base stock used in combination with HVI-PAO to achieve the same level of low temperature viscometric performance is unexpected.

In the present invention about 60 to 90 wt % of the Group III hydroprocessed base stock, GTL base stock, synthetic or natural waxy hydrocarbon hydroisomerate base stock and mixtures thereof is combined with about 10 to 40 wt % of the HVI-PAO to make the combined base stock. Preferably the ratio of HVI-PAO to the Group III hydroprocessed base stock, GTL base stock, synthetic or natural waxy hydrocarbon hydroisomerate base stock and mixtures thereof is about 1:2, preferably about 1:1, more preferably about 2:1. Formulations made using this blend base stock can further contain an ester component in an amount in the range of about 10 to 25 wt % based on the finished lubricant as well as from about 5 to 12 wt % of an additive or of an additive package such as a manual or automatic transmission additive package. The formulation can further contain from about 20 to 35 wt % of one or more of a conventional high viscosity PAO having KV@ 100° C. in the range of about 80 to 140 $mm^2/s$, preferably about 100 $mm^2/s$.

The Group III hydroprocessed base stock, GTL base stock, synthetic or natural waxy hydrocarbon hydroisomerate base stock and mixtures thereof is characterized as having a KV@100° C. in the range of about 2 to 30 $mm^2/s$, preferably about 3 to 20 $mm^2/s$, more preferably about 3.5 to 15 $mm^2/s$, and a VI of at least about 120.

Group III hydroprocessed base stocks are American Petroleum Institute (API) base stocks characterized as having a viscosity index equal to or greater than 120, contain 0.03 wt % or less sulfur and have 90% or more saturates.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range: (1) separated/fractionated from synthesized GTL materials such as, for example, by distillation, and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or synthesized waxy hydrocarbons; (3) hydrodewaxed or hydroisomerized/cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed, F-T waxes, or mixtures thereof.

GTL base stock(s) and/or base oil(s) derived from GTL materials, especially hydrodewaxed or hydroisomerized cat and/or solvent dewaxed wax or waxy feed, preferably F-T material derived based stock(s) and/or base oil(s), are characterized typically as having kinematic viscosities at 100° C. of from about 2 $mm^2/s$ to about 50 $mm^2/s$ (ASTM D445). They are further characterized typically as having pour points of about −5° C. to about −40° C. or lower (ASTM D97). They are also characterized typically as having viscosity indices of about 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

In a preferred embodiment, the GTL material, from which the GTL base stock(s) and/or base oil(s) is/are derived is an F-T material (i.e., hydrocarbons, waxy hydrocarbons, wax).

In addition to the Group III base stock or GTL base stock, base stocks suitable for use in the present invention include base stocks and/or base oils derived from the hydrodewaxing or hydroisomerization/cat (and/or solvent) dewaxing of natural wax or waxy feeds, mineral and/or non-mineral oil waxy feed stocks such as gas oils, slack waxes (derived from the solvent dewaxing of natural oils, mineral oils or synthetic; e.g., slack wax from the solvent/dewaxing of F-T waxy stocks, Fischer-Tropsch feed stocks), natural waxes, and other waxy stocks such as waxy fuels hydrocracker bottoms, waxy raffinate, hydrocrackate, thermal crackates, foots oil or other mineral, mineral oil, or even non-petroleum oil-derived waxy materials such as waxy materials recovered from coal liquefaction or shale oil, linear or branched hydrocarbyl compounds with carbon number of about 20 or greater, preferably about 30 or greater and mixtures of such base stocks and/or base oils.

The HVI-PAO employed in the present invention is characterized as having a KV@100° C. in the range of about 3 to about 1000 $mm^2/s$, preferably about 3 to 500 $mm^2/s$, more preferably about 150 to 300 $mm^2/s$, more preferably about 120, preferably at least about 140, more preferably at least about 160. HVI-PAO is distinguished from conventional PAO having the same or similar molecular weights, kinematic viscosity indices and pour points by the branchiness of the HVI-PAO and the methods employed for its synthesis. While an HVI-PAO and a conventional PAO might both have the same kinematic viscosity, viscosity index, pour point, etc. and, therefore, appear to be nominally the same, they differ in how they perform, in their structural morphology and in how they are synthesized.

Conventional PAOs are made by the polymerization of $C_2$ to $C_{32}$ alpha olefins, preferably $C_8$ to $C_{16}$ alpha olefins such as 1-octene, 1-decene, 1-dodecene and the like in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl propionate.

In comparison, HVI-PAO are a distinct class of PAO, different from conventional PAO, the HVI-PAO being prepared by, for instance, polymerization of alpha olefins using reduced metal oxide catalysts (e.g., reduced chromium on silica gel), zeolite catalysts, activated metallocene catalysts, or Ziegler-Natta (ZN) catalysts. HVI-PAOs are further distinguished and differentiated from conventional PAOs by their possession of branch ratios of less than 0.19, a weight average molecular weight of between 300 and 45,000, a number average molecular weight of between 300 and 18,000, a molecular weight distribution of between 1 and 5, a pour point below −15° C. For the purposes of the present application and the appended claims, viscosity index is measured by ASTM D2270, kinematic viscosity is measured by ASTM D445, pour point is measured by ASTM D97.

High viscosity index polyalphaolefin (HIV-PAO) are prepared by, for example, polymerization of alphaolefins using supported solid reduced Group VIB metal oxide catalysts (e.g., reduced chromium on silica gel under oligomerization conditions at a temperature of about room temperature to 250° C.), zeolite catalysts, activated metallocene catalysts (e.g., catalyst systems comprising a metallocene and an alumoxane) and Ziegler-Natta (ZN) catalysts such as described in U.S. Pat. Nos. 4,827,064; 4,827,073; 4,912,272; 4,914,254; 4,990,771; 4,926,004; 4,967,032, 5,012,020; 5,264,642; and 5,859,159. These HVI-PAOs are characterized by having a high viscosity index (VI) and one or more of the following characteristics: a branch ratio of less than 0.19, a weight average molecular weight of between 300 and 45,000, a number average molecular weight of between 300 and 18,000, a molecular weight distribution of between 1 and 5, and pour point of about −15° C. or less. Measured in carbon number, these molecules range from $C_{30}$ to $C_{1300}$. Viscosities of the HVI-PAO oligomers useful in the present invention measured at 100° C. range from about 3 $mm^2/s$ to about 1,000 $mm^2/s$, preferably about 3 to about 500 $mm^2/s$, more preferably about 100 to about 400 $mm^2/s$, still more preferably about 150 to about 300 $mm^2/s$. These HVI-PAOs have been used as base stocks since their commercial production and are commercially available, such as, for instance, SpectraSyn Ultra™ fluids, from ExxonMobil Chemical Company.

The HVI-PAOs useful in the present invention are characterized by having a high viscosity index (VI), preferably 120 or greater, more preferably 140 or greater, and still more preferably 160 or greater, yet more preferably 200 or greater, and yet still more preferably 250 or greater. An upper limit on VI, while not critical to the characterization of HVI-PAOs useful in the present invention, is about 350. VI as used herein are measured according to ASTM D2270.

The HVI-PAOs generally are characterized by the following: $C_{30}$ to $C_{1300}$ hydrocarbons, a branch ratio of less than 0.19, a weight average molecular weight of between 300 and 45,000, a number average molecular weight of between 300 and 18,000, a molecular weight distribution of between 1 and 5.

Particularly preferred HVI-PAOs are fluids with kinematic viscosity @ 100° C. ranging from about 150 to about 300 $mm^2/s$. The term "kinematic viscosity" as used herein will be referred to simply as viscosity, unless otherwise noted, and will be the viscosity determined according to ASTM D445 at the temperature specified, usually 100° C. When no temperature is mentioned, 100° C. should be inferred.

The HVI-PAOs may be further characterized, in an embodiment, by a low pour point, generally about −15° C. or lower, as determined by ASTM D97.

The term "PAO" in HVI-PAOs means, as is generally accepted in the art, oligomers (low molecular weight polymer) of one or more alpha olefins, such as 1-decene. In embodiments, the HVI-PAOs of the invention may be further characterized as hydrocarbon compositions comprising the oligomers of one or more 1-alkenes selected from $C_6$ to $C_{36}$ 1-alkenes, more preferably $C_6$ to $C_{20}$, still more preferably $C_6$ to $C_{14}$. Examples of the feeds can be 1-hexene, 1-octene, 1-decene, 1-dodecene, 1-tetradecene, etc., or mixtures thereof, such as one or more of $C_6$ to $C_{36}$ 1-alkenes, or one or more C6 to C20 1-alkenes, or one or more $C_6$ to $C_{14}$ alkenes, or mixtures of specific 1-alkenes, such as a mixture of $C_6$ and $C_{12}$ 1-alkenes, a mixture of $C_6$ and $C_{10}$ 1-alkenes, a mixture of $C_8$ and $C_{12}$ 1-alkenes, or a feed comprising at least two 1-alkenes selected from the group consisting of $C_8$, $C_{10}$ and $C_{12}$ 1-alkenes, and so forth, although oligomers of lower olefins such as ethylene and propylene may also be used, including copolymers of ethylene with higher olefins.

The HVI-PAO fluid can be made by reacting the olefin monomers in the presence of a conventional Ziegler or Ziegler-Natta catalyst; e.g., $TiCl_4$, $TiCl_3$, $VCl_4$ or $VOCl_3$, with promoter, such as magnesium chloride, zinc chloride, etc. and with an activator(s), including trialkylaluminum, trialkylboron, and/or a halide such as organo-aluminum halides and/or hydrogen halides. There are many variations of Ziegler or Ziegler-Natta catalysts, as described in the book *Ziegler-Natta Catalysts and Polymerizations* by John Boor, Jr., Academic Press, New York 1979.

While the olefin copolymers (OCP) made using Ziegler-Natta catalysts tend to have number average molecular weight of about 10,000 or more, and many of the conventional VI improver OCP are made by such method, as reviewed in Chapter 10 of *Lubricant Additives, Chemistry and* Applications, Ed. by L. R. Rudnick, Marcel Dekker, Inc., New York 2003, the process using Ziegler or Ziegler-Natta catalysts can also be used to prepare the HVI-PAO fluid suitable for use in the present invention.

Preferably the HVI-PAO fluids used in the present invention are produced using a catalyst system comprising a metallocene and an aluminoxane. See, for example, U.S. Pat. No. 4,668,834; U.S. Pat. No. 4,704,491; WO 90/1503; U.S. Pat. No. 5,043,515; U.S. Pat. No. 5,859,159; U.S. Pat. No. 5,498,809. The polyolefin fluids which are preferred in the present invention are those synthesized using metallocene catalysts and are characterized as having a molecular weight distribution (MWD) defined as the ratio of the weight average molecular weight to the number average molecular weight of about 5 or less. The HVI-PAO fluids have a MWD of from about 1 to 5. Both number average and weight average molecular weight can be determined by the technique of gel permeating chromatograph (GPC) with a suitable calibration curve, as is known to those skilled in the art.

The polymerization reaction for the production of polyolefin fluids from a first alpha olefin such as ethylene, propylene, 1-butylene reacted with a second, different alpha olefin which is a straight or branched chain alpha olefin selected from $C_2$-$C_{30}$ alpha olefin and mixtures thereof, preferably $C_2$-$C_{14}$ straight or branched chain alpha olefin and mixtures thereof, is conducted in the presence of a catalyst system comprising at least one metallocene (e.g., a cyclopentadienyl-transition metal compound) and preferably an activator; e.g., an alumoxane compound. The term metallocene refers to compounds containing a coordination bond between a transition metal and at least one cyclopentadiene ring structure. The term cyclopentadiene ring structure includes saturated or unsaturated polycyclic structures such as indenyl and fluorenyl which incorporate a five-membered ring. The co-monomer content can be controlled through the selection of the metallocene catalyst component and by controlling the relative proportions of the feed olefins, usually ethylene and alpha-olefin; e.g., ethylene and 1-butene or ethylene and propylene, or ethylene and 1-pentene, or ethylene and propylene and 1-butene.

The catalysts employed in the production of these polyolefin fluids are organometallic coordination compounds which are cyclopentadienyl derivatives of a Group IVB metal of the Periodic Table of the Elements ($56^{th}$ Edition of *Handbook of Chemistry and Physics*, CRC Press, 1975) and include mono- di- and tricyclopentadienyls and their derivatives of the transition metals. Particularly desirable are the metallocenes of Group IVB metal such as titanium, zirconium and hafnium. These metallocenes are further activated with an alumoxane. The alumoxanes employed in forming the reaction product with the metallocenes are themselves the reaction products of an aluminum trialkyl with water or precursors which act as water source, such as copper sulfate hydrates.

In general, at least one metallocene compound is employed in the formation of the catalyst. Metallocene is a metal derivative of a cyclopentadiene. The metallocenes usefully employed in accordance with this invention contain at least one cyclopentadiene ring. The metal is selected from the Group IVB, preferably titanium, zirconium, and hafnium, and most preferably hafnium and zirconium. The cyclopentadienyl ring can be unsubstituted or contain one or more substituents (e.g., from 1 to 5 substituents) such as, for example, a hydrocarbyl substituent (e.g., up to 5 C1 to C5 hydrocarbyl substituents) or other substituents; e.g., such as, for example, a trialkyl silyl substituent. The metallocene can contain one, two or three cyclopentadienyl rings; however, two rings are preferred.

Useful metallocenes can be represented by the general formulas:

$$(C_p)_m MR_n X_q \quad \text{(I)}$$

wherein $C_p$ is a cyclopentadienyl ring, M is a Group IVB transition metal, R is a hydrocarbyl group or hydrocarboxy group having from 1 to 20 carbon atoms, X is a halogen, and m is a whole number from 1 to 3, n is a whole number from 0 to 3, and q is a whole number from 0 to 3;

$$(C_5R'_k)_g R''_s (C_5R''_k) MQ_{3-g} \quad \text{(II)}$$

and $$R''_s (C_5R'_k)_2 MQ' \quad \text{(II)}$$

wherein $(C_5R'_k)$ is a cyclopentadienyl or substituted cyclopentadienyl, each R' is the same or different and is hydrogen or a hydrocarbyl radical such as alkyl, alkenyl, aryl, alkylaryl, or arylalkyl radical containing from 1 to 20 carbon atoms, a silicon containing hydrocarbyl radical, or hydrocarbyl radicals wherein two carbon atoms are joined together to form a $C_4$-$C_6$ ring, R" is a $C_1$-$C_4$ alkylene radical, a dialkyl germanium or silicon, or an alkyl phosphine or amine radical bridging two $(C_5R'_k)$ rings, Q is a hydrocarbyl radical such as aryl, alkyl, alkenyl, alkylaryl, or arylalkyl radical having from 1-20 carbon atoms, hydrocarboxy radical having from 1-20 carbon atoms or halogen and can be the same or different from each other, Q' is an alkyldiene radical having from 1 to about 20 carbon atoms, s is 0 or 1, g is 0, 1 or 2, s is 0 when g is 0, k is 4 when s is 1, and k is 5 when s is 0, and M is defined as above. Exemplary hydrocarbyl radicals are methyl, ethyl, propyl, butyl, amyl, isoamyl, hexyl, isobutyl, heptyl, octyl, nonyl, decyl, cetyl, 2-ethyl-hexyl, phenyl and the like. Exemplary silicon containing hydrocarbyl radicals are trimethylsilyl, triethylsilyl and triphenylsilyl. Exemplary halogen atoms include chlorine, bromine, fluorine and iodine and, of these halogen atoms, chlorine is preferred. Exemplary hydrocarboxy radicals are methoxy, ethoxy, butoxy, amyloxy and the like. Exemplary of the alkylidene radicals is methylidene, ethylidene and propylidene.

The alumoxane compounds useful in the polymerization process may be cyclic or linear or the combination of the two. Cyclic alumoxanes may be represented by the general formula $(R—Al—O)_n$ while linear alumoxanes may be represented by the general formula $R(R—Al—O)_{n'}AlR_2$. In the general formula R is a $C_1$-$C_5$ alkyl group such as, for example, methyl, ethyl, propyl, butyl and pentyl, n is an integer of from 3 to 20, and n' is an integer from 1 to about 20. Preferably, R is methyl and n and n' are 4-18. Generally, in the preparation of alumoxanes from, for example, aluminum trimethyl and water, a mixture of the linear and cyclic compounds is obtained.

The alumoxane can be prepared in various ways. Preferably, they are prepared by contacting water with a solution of aluminum trialkyl, such as, for example, aluminum trimethyl, in a suitable organic solvent such as toluene or an aliphatic hydrocarbon. For example, the aluminum alkyl is treated with water in the form of a moist solvent. In an alternative method, the aluminum alkyl such as aluminum trimethyl can be desirably contacted with a hydrated salt such as hydrated copper sulfate or ferrous sulfate. Preferably, the alumoxane is prepared in the presence of a hydrated ferrous sulfate. The method comprises treating a dilute solution of aluminum trimethyl in, for example, toluene, with ferrous sulfate represented by the general formula $FeSO_4,7H_2O$. The ratio of ferrous sulfate to aluminum trimethyl is desirably about 1 mole of ferrous sulfate for 6 to 7 moles of aluminum trimethyl. The reaction is evidenced by the evolution of methane. General method to produce methylaluminoxane (MAO) or other alumoxane can be found in many patents: U.S. Pat. No. 5,663,394, U.S. Pat. No. 5,693,838, U.S. Pat. No. 6,194,340, U.S. Pat. No. 6,518,445, etc.

The mole ratio of aluminum in the alumoxane to total metal in the metallocenes which can be usefully employed can be in the range of about 0.5:1 to 5000:1, and desirably about 1:1 to 1000:1. Preferably, the mole ratio will be in the range of about 500:1 to 5:1 and most preferably about 250:1 to 5:1.

The solvents used in the preparation of the catalyst system are inert hydrocarbons, in particular a hydrocarbon that is inert with respect to the catalyst system. Such solvents are well known and include, for example, isobutene, butane, pentane, hexane, heptane, octane, cyclohexane, methylcyclohexane, toluene, xylene and the like.

Polymerization is generally conducted at temperatures ranging between 20° C. and 300° C., preferably between about 30° C. and 200° C. The polymerization feeds, including the olefins, the solvents and any other feed gases, preferably are purified by passing through molecular sieves and/or oxygenate removal catalyst beds, as typically practiced in polyolefins synthesis. The purpose of the purification is to remove water, oxygenates or any other trace polar components that can deactivate the polymerization catalysts. Usually highly purified feed streams result in high catalyst productivities and high lube selectivity, simplified work up or product isolation step, narrower molecular weight distribution. All these are beneficial for an economical process and more desirable product. Reaction time is not critical and may vary from several hours or more to several minutes or less, depending upon factors such as reaction temperature and the like. One of ordinary skill in the art may readily obtain the optimum reaction time for a given set of reaction parameters by routine experimentation.

The catalyst systems described herein are suitable for the polymerization of ethylene and alpha-olefins in solution over a wide range of pressures. The polymerization can be complete at a pressure of from about 10 to 3,000 bar. The polymerization reaction can be conducted in batch mode, semi-batch or semi-continuous mode, or in continuous stir tank reactor (CSTR) mode.

After polymerization and, optionally, deactivation of the catalyst (e.g., by conventional techniques such as contacting the polymerization reaction medium with water or an alcohol, such as methanol, propanol, isopropanol, etc., or cooling or flashing the medium to terminate the polymerization reaction), the product polymer can be recovered by distillation under vacuum to remove light fraction, which has a boiling point below 650° F. at atmospheric pressure. The residual oil fraction can be used as is for this invention. Or more preferably, the residual oil fraction is further hydrogenated using standard hydrofinishing conditions, such as under 500-2000 psi $H_2$ pressure, 100-250° C. and 2 wt % nickel on Kieselguhr catalyst for proper amount of time to reduce the degree of unsaturation down to low bromine number, usually below 2. Usually, the lower the bromine number the better the product, especially the better oxidative stability.

The polymerization may be conducted employing the liquid alpha-olefin reactant as solvent. For example, 1-butene or propylene or other appropriate alpha-olefin liquid can be used as the reaction medium. Alternatively, polymerization may be accomplished in the presence of a hydrocarbon inert to the polymerization such as butane, isobutene, pentane, isopentane, hexane, isooctane, decane, toluene, xylene, and the like.

Another method to produce these HVI-PAO fluids is by using Friedel-Crafts polymerization catalysts. For example, the high viscosity polyolefin fluids can be made from ethylene and alpha-olefins in range from 0% ethylene to 50 wt % ethylene as feed. The other alpha-olefins can be propylene, 1-butene, mixed butenes or mixed butanes in BB stream, linear alpha-olefins, including 1-hexene, 1-octene, 1-decene, 1-dodecene, 1-tetradecene, 1-hexadecene, 1-octadecene, or the mixture of them. The amount of these alpha-olefins in the feed ranges from 50 wt % to 100 wt %.

The HVI-PAOs which are known materials and fall within the present definition of polyolefin fluids as used herein are generally available on a major commercial scale from suppliers such as ExxonMobil Chemical Company, Chevron, BP and others.

In the preparation of HVI-PAOs useful in the present invention, the lube products usually are distilled to remove any low molecular weight compositions such as those boiling below about 600° F. (about 315° C.), or with carbon number less than $C_{20}$, if they are produced from the polymerization reaction or are carried over from the starting material. This distillation step usually improves the volatility of the finished fluids. In certain special applications, or when no low boiling fraction is present in the reaction mixture, this distillation is not necessary. Thus, in preferred embodiments, the whole reaction product after removing any solvent or starting material can be used as lube base stock or for the further treatments.

The lube fluids made directly from the polymerization or oligomerization process usually have unsaturated double bonds or have olefinic molecular structure. The amount of double bonds or unsaturation or olefinic components can be measured by several methods, such as bromine number (ASTM 1159), bromine index (ASTM D2710) or other suitable analytical methods, such as NMR, IR, and the like, well known per se to one of ordinary skill in the art. The amount of double bond or the amount of olefinic compositions depends on several factors—the degree of polymerization, the amount of hydrogen present during the polymerization process and the amount of hydrogen present during the polymerization process and the amount of other promoters which particulate in the termination steps of the polymerization process, or other agents present in the process. Usually, the amount of double bonds or the amount of olefinic components is decreased by the higher degree of polymerization, the higher amount of hydrogen gas present in the polymerization process, or the higher amount of promoters participating in the termination steps.

Oxidative stability and light or UV stability of fluids usually improves when the amount of unsaturation double bonds or olefinic contents is reduced. Therefore in preferred embodiments, it is necessary to further hydrotreat the polymer if they have high degree of unsaturation. Usually, the fluids with bromine number of less than 5, as measured by ASTM D1159, is unsuitable for high quality base stock applications of the invention. Fluids with bromine number of less than 3 or 2 are preferred. The most preferred range is less than 1 or less than 0.1.

The HVI-PAOs are hydrotreated to reduce unsaturation. This may be done by methods well known per se in literature (e.g., U.S. Pat. No. 4,827,073, example 16). In some HVI-PAO products, the fluid made directly from the polymerization already have very low degree of unsaturation, such as those with viscosities greater than 150 cSt at 100° C. They have bromine numbers less than 5 or even below 2. In these cases, the direct product may be used without hydrotreating. Thus, hydrotreatment of the HVI-PAO product is optional, depending on the method used to make the HVI-PAO and the end use.

EXPERIMENTAL

Experiments were performed combining various Group III base oils and a GTL base stock with conventional PAO-100, PAO-4, and HVI-PAO, along with blending conventional PAO-100 with PAO-4, all in combination with 20% of an ester and 9 wt % conventional transmission fluid additives, based on the weight of the total compositions.

The results of these experiments are presented in Table 1:

TABLE 1

SAE 50 Transmission Fluid or 75W-90 Gear Oil

| Vis Grade | A | B | B' | B" | B"' | C | D | D' | D" | D"' |
|---|---|---|---|---|---|---|---|---|---|---|
| Wt % Hi VI-PAO (VI = 160) | | | | | | 45 | 45 | 45 | 45 | 45 |
| Wt % Conventional PAO-100 (VI = 160) | 45 | 45.5 | 45.5 | 45 | 45 | | | | | |
| Wt % Light PAO (4 cSt) (VI = 125) | 25.9 | | | | | 25.9 | | | | |
| Wt % Group III (Visom)(4 cSt) | | 25.4 | | | | | 25.9 | | | |
| Wt % Group III (Yubase) (4 cSt) | | | 25.4 | | | | | 25.9 | | |
| Wt % Group III (GTL 3.6) | | | | 25.9 | | | | | 25.9 | |
| Wt % Group I (AP/E Core 100)(4 cSt) | | | | | 25.9 | | | | | 25.9 |
| Wt % Additives | 9 | 9 | 9 | 9 | 9 | 9 | 9 | 9 | 9 | 9 |
| Ester (5.3 cSt)* | 20 | 20 | 20 | 20 | 20 | 20 | 20 | 20 | 20 | 20 |
| Vis at 100° C. | 15.7 | 15.2 | 15.5 | 15.5 | 16.8 | 16.2 | 15.9 | 15.5 | 15.7 | 17.1 |
| VI | 183 | 181 | 180 | 189 | 180 | 199 | 206 | 190 | 201 | 192 |
| Brookfield Viscosity, cP | 33,150 | 82,182 | 167,200 | 66,486 | 615,869 | 20,500 | 20,950 | 22,245 | 21,245 | 49,989 |
| Pour Point, ° C. | −51 | −51 | −45 | −45 | −42 | −51 | −54 | −51 | −45 | −48 |

| Vis Grade | E | F | F' | F" | F"' | G | H | H' | H" | H"' |
|---|---|---|---|---|---|---|---|---|---|---|
| Wt % Hi VI-PAO (VI = 160) | 22.5 | 22.5 | 22.5 | 22.5 | 22.5 | 11.25 | 11.25 | 11.25 | 11.25 | 11.25 |
| Wt % Conventional PAO-100 (VI? = 160) | 22.5 | 22.5 | 22.5 | 22.5 | 22.5 | 33.75 | 33.75 | 33.75 | 33.75 | 33.75 |
| Wt % Light PAO (4 cSt) (VI? = 125) | 25.9 | | | | | 25.9 | | | | |
| Wt % Group III (Visom)(4 cSt) | | 25.9 | | | | | 25.9 | | | |
| Wt % Group III (Yubase) (4 cSt) | | | 25.9 | | | | | 25.9 | | |
| Wt % Group III (GTL 3.6) | | | | 25.9 | | | | | 25.9 | |
| Wt % Group I (AP/E Core 100)(4 cSt) | | | | | 25.9 | | | | | 25.9 |
| Wt % Additives | 9 | 9 | 9 | 9 | 9 | 9 | 9 | 9 | 9 | 9 |
| Ester (5.3 cSt)* | 20 | 20 | 20 | 20 | 20 | 20 | 20 | 20 | 20 | 20 |
| Vis at 100° C. | 15.7 | 14.7 | 15.2 | 15.5 | 16.8 | 15.9 | 15.3 | 15.3 | 15.5 | 16.5 |
| VI | 188 | 181 | 182 | 194 | 185 | 189 | 189 | 183 | 192 | 183 |

TABLE 1-continued

| SAE 50 Transmission Fluid or 75W-90 Gear Oil | | | | | | | | | | |
|---|---|---|---|---|---|---|---|---|---|---|
| Brookfield Viscosity, cP | 28,294 | 41,391 | 41,341 | 36,642 | 159,166 | 26,494 | 53,243 | 53,889 | 45,740 | 323,131 |
| Pour Point, ° C. | −54 | −48 | −48 | −45 | −42 | −54 | −54 | −45 | −45 | −42 |

*Esterex A-32.

As seen and was already known in the industry, the addition of PAO-4 to formulations can improve low temperature performance in transmission fluids and gear oils with stringent Brookfield viscosity limits.

Table 1 shows conventional blends made by combining conventional cPAO (100 cSt) with PAO-4 (Blend A), with Group III (Visom-4) (Blend B) and with Group III (Yubase 4) (Blend B'), with GTL-3.6 (Blend B"), and with a Group I stock (Blend B'''), at similar concentrations. The Brookfield viscosity of Blend (A) is lower than for Blend B or Blend B' which utilize Group III stocks as well as for Blend B" which used GTL-3.6 and Blend B''' which used a Group I stock. This was expected from the literature. The results are as expected when using conventional cPAO (100) with PAO-4, and conventional cPAO (100) with Group III stocks, as well as with GTL and Group I base stocks. The low temperature performance is unacceptable with the Group III GTL and Group I base stocks as compared to the PAO-4. Blend B and B' resulted in Brookfield viscosities about three to five times higher than the blend using PAO-4 as the co-base stock (Blend A).

In comparison, for Blend C and inventive blends, Blend D, Blend D' and Blend D" where conventional cPAO 100 is replaced with HVI-PAO at the same concentration, the Brookfield viscosity was unexpectedly and uniformly lower and superior to that even of reference Blend A. While for Blend D", the blend using HVI-PAO and GTL-3.6 the pour point rose to −45° C., the extremely low Brookfield viscosity of 21,245 cP indicates even the fluid exhibits an unexpected improvement in performance as compared to reference Blend A.

This improvement is not seen when Group I oil is employed in place of the Group III base stock or GTL-3.6 in combination with the HVI-PAO. In Blend D''' which mixes a Group I base stock with HVI-PAO, the Brookfield viscosity is an unacceptable 49,989 cP while the pour point is −48° C.

Additional blends were prepared to determine if the enhancement in low temperature properties could be secured at concentrations of HVI-PAO as low as 25% or 11.25% of the formulation.

Blends E, F, F', F" and F''' report blends with a 50:50 ratio of conventional cPAO (100) to HVI-PAO in combination with PAO-4 (Blend E), Group III Visom 4 (Blend F), Group III Yubase-4 (Blend F'), GTL-3.6 (Blend F") and Group I (Blend F''').

Blend E shows a slight decrease in apparent viscosity by ASTM D2983 when the ratio of cPAO-100 to HVI-PAO is 50:50 (22.5 wt % HVI-PAO in the blend). Although the Brookfield viscosity for Blend E is higher than that for reference Blend A, it is still within 30% of the value found for Blend A while the pour point is within the margin of error of the test and thus meets that of Blend A. In comparison, for Blends F, F', F" and F''', while both the Brookfield viscosities and pour points have moved into regions which are inferior in comparison to reference Blend A, they are still unexpectedly superior to Blends B, B" and B'''.

Blends, G, H, H', H" and H''' summarize the results when HVI-PAO content is reduced to 11.25 wt % of the formulation and the ratio of cPAO-100 to HVI-PAO is 75:25.

The Brookfield viscosities are higher than the best results exhibited by Blends C, D, D' and D''', but still unexpectedly superior to the Brookfield viscosities exhibited by Blends B, B' and B".

Overall, it is unexpectedly seen that the use of Group III and GTL base stocks with HVI-PAO base stocks provides enhanced low temperature performance similar to that using PAO-4 (Blend A), but not obtained when using cPAO-100 base stocks (Blends B through B"). As much as 70% improvement in Brookfield viscosities are observed in blends with HVI-PAO concentration as low as 11.25 wt % compared to using cPAO alone (Blend H' vs. Blend B'), while the total replacement of cPAO-100 with HVI-PAO produces blends which are superior in terms of the Brookfield viscosity and at least meet the pour points of oils formulated using PAO-4 and cPAO-100 (Blends D, D' and D" vs. Blend A).

What is claimed is:

1. A method for producing lubricating oil formulations having a pour point of about −45° C. or lower and a Brookfield viscosity at −40° C. of about 60,000 cP or lower using a base (a) stock selected from the group consisting of Group III hydroprocessed base stock, GTL base stock or mixture thereof, by adding to the base stock (a) at least about 10 wt % HVI-PAO based on the total lubricating oil formulation wherein the ratio of the HVI-PAO to base stock (a) is at least 1:2 and adding about 10 to 25 wt % of an ester to the lubricating oil formulation with the proviso that the lubricating oil formulation does not include a light PAO (4 cSt) or an API Group I base stock.

2. The method of claim 1 wherein the pour point is about −50° C. or less.

3. The method of claim 1 wherein the Brookfield viscosity at −40° C. is about 30,000 cP or less.

4. The method of claim 1 wherein the Brookfield viscosity at −40° C. is about 25,000 cP or less.

5. The method of claim 2 wherein the Brookfield viscosity at −40° C. is about 30,000 cP or less.

6. The method of claim 2 wherein the Brookfield viscosity at −40° C. is about 25,000 cP or less.

7. The method of claim 1, 2, 3, 4, 5 or 6 wherein the HVI-PAO is added in an amount of at least about 22.5 wt % based on the total lubricating oil formulation.

8. The method of claim 1, 2, 3, 4, 5 or 6 wherein the HVI-PAO is added in an amount of at least about 45 wt % based on the total lubricating oil formulation.

9. The method of claim 7 wherein the wt ratio of HVI-PAO to base stock (a) is about 1:1.

10. The method of claim 8 wherein the wt ratio of HVI-PAO to base stock (a) is about 1:1.

11. The method of claim 7 wherein the wt ratio of HVI-PAO to base stock (a) is about 2:1.

12. The method of claim 8 wherein the wt ratio of HVI-PAO to base stock (a) is about 2:1.

13. The method of claim 1, 2, 3, 4, 5 or 6 further comprising the step of adding about 5 to 12 wt % of an additive or additive package to the lubricating oil formulation.

14. The method of claim 1, 2, 3, 4, 5 or 6 wherein the HVI-PAO is characterized by a KV@100° C. in the range of about 3 to about 1000 $mm^2/s$, a VI of at least about 120, a branch ratio of less than 0.19, a weight average molecular weight of between 300 and 45,000, a number average molecular weight of between 300 and 18,000, a molecular weight distribution of between 1 and 5 and a pour point of about −15° C. or less.

15. The method of claim 14 wherein the HVI-PAO has a KV@100° C. in the range of about 150 to 300 $mm^2/s$.

16. The method of claim 1, 2, 3, 4, 5 or 6 further comprising the step of adding about 20 to about 35 wt % of a conventional high viscosity PAO to the lubricating oil formulation.

* * * * *